United States Patent [19]

Evans

[11] 4,184,390

[45] Jan. 22, 1980

[54] RATCHETING WRENCH WITH ROTATING FEATURE

[75] Inventor: James P. Evans, Oklahoma City, Okla.

[73] Assignee: Paul H. Johnson, Tulsa, Okla. ; a part interest

[21] Appl. No.: 863,321

[22] Filed: Dec. 22, 1977

[51] Int. Cl.[2] ..... B25B 17/00

[52] U.S. Cl. ..... 81/57.3

[58] Field of Search ..... 81/58.1, 57.3

[56] References Cited

U.S. PATENT DOCUMENTS

| | | | |
|---|---|---|---|
| 2,466,456 | 4/1949 | Lybyer | 81/57.3 |
| 2,608,947 | 9/1952 | Ames | 33/147 F |
| 2,678,577 | 5/1954 | Tackett | 81/57.3 |
| 2,746,331 | 5/1956 | Andersen | 81/58.1 |
| 3,283,621 | 11/1966 | Faso | 81/58.1 |

*Primary Examiner*—James L. Jones, Jr.

*Attorney, Agent, or Firm*—Head & Johnson

[57] ABSTRACT

A ratcheting wrench having a handle configured to be engaged by the hand of the user, the handle having a top, bottom, and opposed sides, a ratchet member rotatably supported at one end of the handle having means to engage a nut or bolt to be rotated, and an endless belt carried by the handle and rotated with the ratchet member, the belt being exposed at at least one area of one side of the handle so that it may be engaged by the thumb or fingers or the user to enable the user to apply rotational torque to the ratchet member.

6 Claims, 9 Drawing Figures

RATCHETING WRENCH WITH ROTATING FEATURE

BACKGROUND AND OBJECTS OF THE INVENTION

Ratchet wrenches are well known and commonly used tools for rotating all kinds of devices, particularly nuts and bolts. A ratchet wrench typically has a handle with a ratcheting means at one end. In the most common arrangement the ratchet tool includes a ratcheting means having a male extending portion, usually square in cross-section, which detachably receives a plurality of sockets configured to engage different sizes of bolts and nuts.

Another type of ratcheting tool includes an arrangement having a female type head to receive bolts and nuts. This type wrench is less expensive to produce but will receive only a single size nut or bolt. Frequently this type wrench includes a female socket arrangement at each end so that the same wrench can fit two different sizes of nuts or bolts.

Socket wrenches are preferred by workmen because of their speed and efficiency. Once the ratcheting wrench is affixed to a bolt it can be rotated towards the open or closed position by reciprocating the wrench handle. One problem with all type of ratcheting wrenches, however, is that there is always a slight amount of torque applied to the bolt or nut to which the wrench is affixed when the handle is rotated in the opposite direction to that by which torque is applied. All ratcheting wrenches have a ratchet mechanism which interlocks the handle with the ratcheting member when the handle is rotated in one direction but which allows the handle to rotate relative to the ratchet mechanism when the handle is rotated in the opposite direction. In this opposite direction motion there is, nevertheless, some slight torque applied to the ratcheting mechanism due to frictional engagement of components, or the sliding of a pall on a ratchet gear. When a nut or bolt has sufficient rotational friction, this slight rearward torque is of no problem. However, when a nut or bolt is loosely fitted in position, such as in the initial stages of tightening or the final stages or loosening, the ratcheting wrench will not work since as the handle is ratcheted it merely rotates the nut or bolt in the same degree of arc. When this occurs the user of the ratchet wrench has no choice other than to remove the wrench and rotate the nut or bolt by hand.

The present invention is directed towards a ratcheting wrench having means to enable the user to apply rotational torque to a nut or bolt being ratcheted even when the handle of the wrench is moved in the non-torqueing direction.

It is therefore an object of this invention to provide an improved ratcheting wrench.

More particularly, an object of this invention is to provide a ratcheting wrench having an endless chain which engages the ratcheting element of the wrench and which can be engaged by the thumb or fingers, or both, of the user, to apply slight torque to the member when the wrench is moved in the direction opposite the torqueing direction.

These general objects of the invention will be fulfilled in the following description and claims, taken in conjunction with the attached drawings.

SUMMARY OF THE INVENTION

An improved ratcheting wrench is disclosed which is distinguished by the characteristic that it enables the user of the wrench, by manipulation of the thumb and forefingers of the hand placed on the wrench handle, to overcome the slight torque which is applied to a member, such as in a nut or bolt, when the ratcheting wrench handle is moved in the direction opposite the torqueing direction. The wrench includes an endless chain member extending along the sides of the wrench handle and exposed in at least one place on at least one side of the wrench, the endless chain engaging the ratcheting mechanism so that by the thumb or fingers of the user placed on the side of the wrench handle where the chain is exposed, torque may be applied to the chain to rotate the ratcheting mechanism. In this manner the ratcheting mechanism can be caused to rotate when the wrench handle is moved in the non-torqueing direction to thereby permit the operator to ratchet a member even when the member has little or no rotational drag.

DETAILED DESCRIPTION OF THE PREFERRED EMBODIMENT

Figure 2:
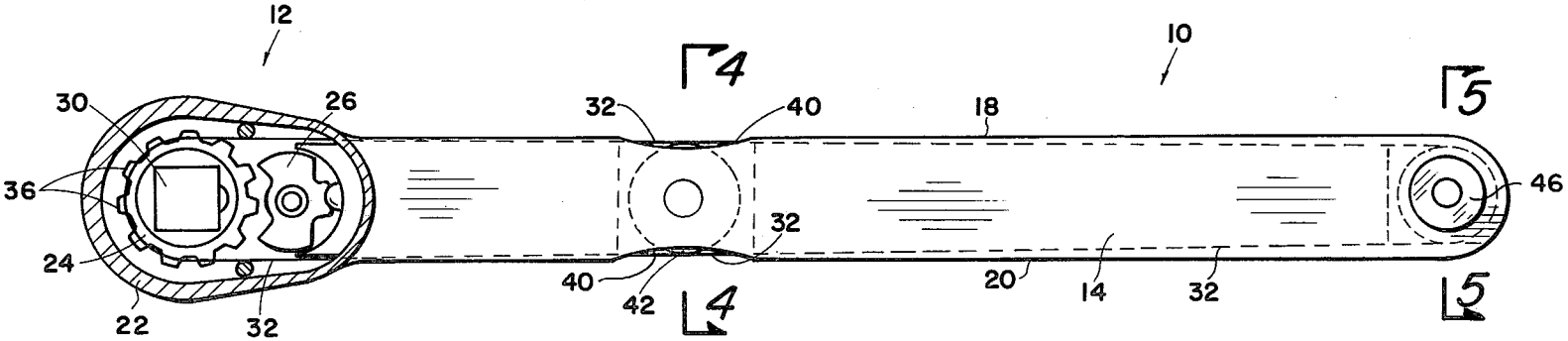
FIG. 2 is a top view, shown partially cut away, of the wrench of FIG. 1, showing the manner in which the endless chain engages the ratcheting mechanism.
Figure 1:
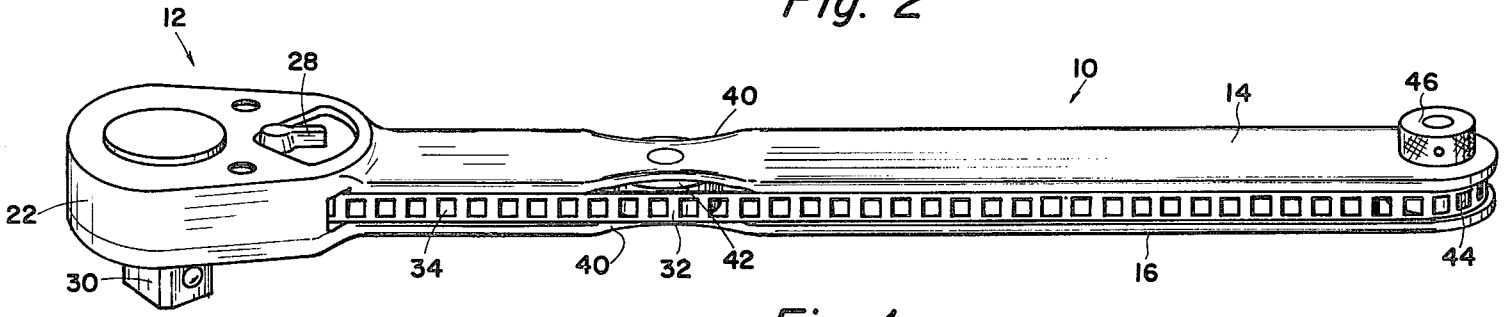
FIG. 1 is an isometric view of a ratchet wrench employing the principles of this invention.

Referring to the drawings and first to FIGS. 1 and 2, an embodiment of a tool employing the invention is illustrated. The wrench includes a handle generally indicated by the numeral 10, and at one end of the handle, a ratcheting mechanism generally indicated by the numeral 12. The handle 10 includes a top 14, a bottom 16, a first side 18, and a second side 20.

The ratcheting mechanism is received in a hollow wrench head 22. This invention is not directed towards any specific type of ratcheting mechanism. Many different mechanisms are presently on the market, and essentially includes a device which locks the mechanism to the handle when the handle is rotated in one direction and which allows the mechanism to move when the handle is rotated in the other direction. Generally such mechanism includes a rack gear 24 and a pall mechanism 26. In FIG. 2 the pall 26 is in the neutral position in which the ratchet gear 24 is free to rotate in either direction without being locked to the handle so that ratcheting of the handle 10 would not apply torque in either direction to the rack gear 24. However, normally the pall 26 will engage the rack gear 24 to lock it to the handle 10 in one direction of movement of the handle and to allow the handle to be in unlocked relationship when it is moved in the other direction. The pall 26 is controlled by lever 28 as shown in FIG. 1.

The rack gear 24 includes a shank 30 which extends exteriorly of the wrench bottom 16. Shank 30 is used to receive a socket (not shown) of the type commonly utilized by mechanics today.

The wrench described up to this point is a standard ratcheting wrench. The essence of this invention is to provide means so that the hand of the user may apply rotational torque to the ratchet mechanism 12 without moving the handle or while moving it. This is accomplished by means of an endless chain 32 which is carried by the wrench handle 10 and is rotatably engaged by the ratchet mechanism 12. In the illustrated arrangement, the chain 32 has a plurality of spaced openings 34 which receive teeth 36 of the rack gear 24. As chain 32 is displaced, the rack gear 24, and thereby the shank 30, is rotated.

Figure 4:
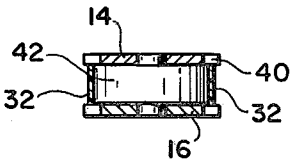
FIG. 4 is a cross-sectional view taken along the line 4—4 of FIG. 2 showing a bearing member received in the handle for increasing the ease of movement of the endless chain by the thumb or forefingers, or both, of the user.

The wrench handle 10 must be configured in such a way that the endless chain 32 is exposed in at least one place on at least one side of the wrench handle so that the endless chain may be engaged by the thumb or fingers of the user. In the arrangement illustrated in FIGS. 1 and 2, the handle top 14 is formed of one plate and the handle bottom 16 is formed of another (see FIGS. 4 and 5). Positioned between the top and bottom plates 14 and 16 is a spacer 38. The width of the spacer 38 is normally less than the width of the top and bottom plates 14 and 16 so that chain 32 is normally received between the top and bottom plates. However, the top and bottom plates are recessed in width at 40 so that the endless chain 32 is exposed to contact by the thumb or fingers, or both, of the user.

In FIGS. 1 and 2, a rotatable bearing member 42, of height slightly less than the thickness of sapcer 38, is rotatably supported between the upper and lower handle plates 14 and 16. The bearing member 42 is positioned between the opposed recesses 40. By this arrangement, the thumb and forefinger of the user may be manipulated in opposite directions to apply force to the chain 32 and thereby rotational torque to the ratchet mechanism 12.

Figure 5:
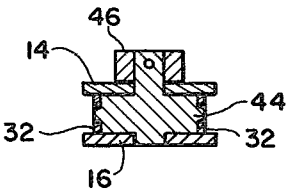
FIG. 5 is a cross-sectional view taken along the line 5—5 of FIG. 2 and showing an embodiment in which a knob is positioned at the end of the wrench handle by which the ratcheting mechanism may be rotated.

As shown in FIG. 5, as an alternate additional element, a sheave 44 may be rotatably secured between the handle upper and lower plates 14 and 16 with a knob 46 above the handle upper plate 14. In this manner, by rotating knob 46, the ratcheting mechanism 12 may be rotated, whether the handle 10 is ratcheted or not. The sheave 44 and knob 46 are ancillary elements to the basic concept of the invention.

Figure 3:
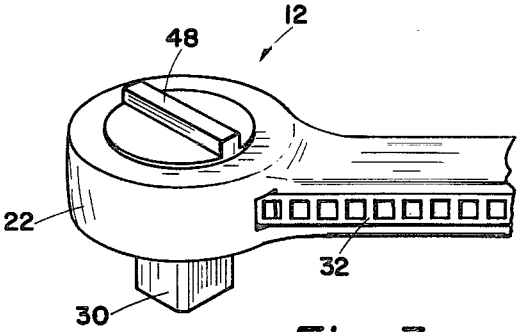
FIG. 3 is an isometric view of one end of a ratcheting wrench as shown in FIG. 2, but showing an alternate embodiment of the ratchet direction selecting mechanism.

FIG. 3 shows the end portion of a wrench of the type commonly marketed today wherein the mechanism 48 for changing the direction that the ratcheting element is locked to the handle is axially located on the side of the wrench head 22 opposite shank 30.

The arrangement wherein the ratchet mechanism includes a rack gear 24 with teeth 36 and in which the endless chain 32 has openings 34 therein is a way of example only. It can be seen that other mechanisms may be provided so that the chain rotates the ratcheting mechanism without the user of a chain having openings or a ratchet mechanism having teeth. A sheave which frictionally engages a chain, which may be flat, or round, or any cross-sectional arrangement, may be utilized. The concept of the invention is fulfilled by any mechanism wherein the chain is exposed to at least one side of the handle for engagement of the chain by the thumb and forefingers. It can be seen that the handle may be designed so that substantially all of the chain is concealed except for that portion which is exposed to the engagement of the thumb or fingers of the user.

Figure 6:
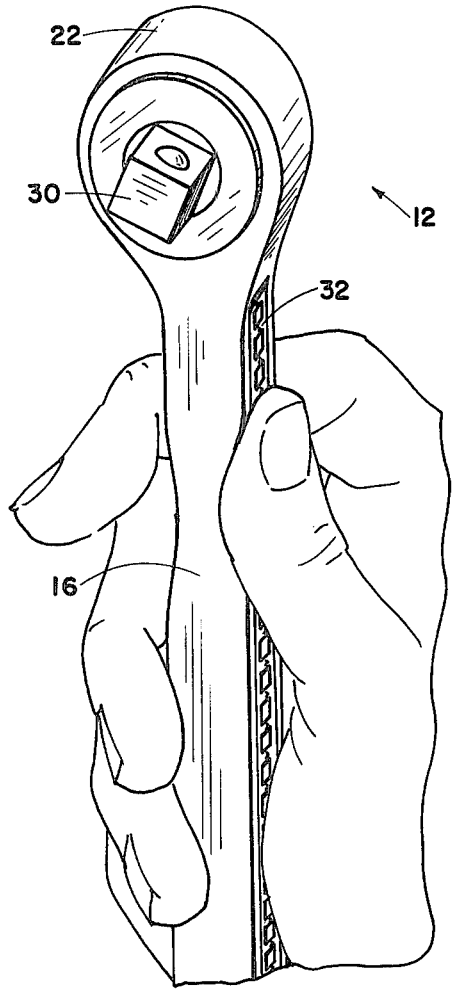
FIG. 6 is an isometric view showing a wrench of the type as illustrated in FIG. 3 and showing the manner in which it may be used by the operator.

FIG. 6 shows the wrench of the type illustrated in FIGS. 1 and 2 in use and showing the thumb and forefingers applied to opposite sides of the wrench handle and in engagement with the endless chain 32 for applying rotational torque to the ratchet mechanism.

Figure 7:
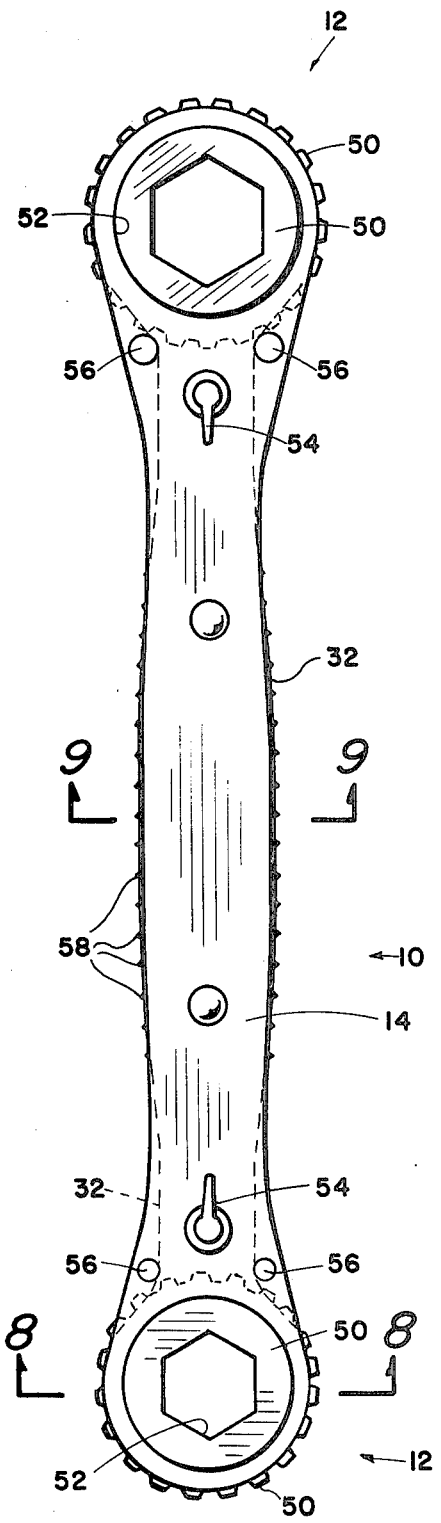
FIG. 7 is a top view of an alternate design of a ratcheting wrench. In this view the wrench is of the type having female ratchet means at each end.
Figure 9:
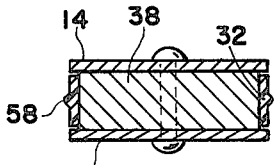
FIG. 9 is a cross-sectional view of the embodiment of the wrench as shown in FIG. 7, taken along the line 9—9 of FIG. 7.
Figure 8:
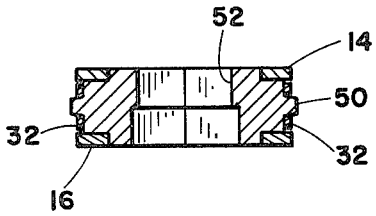
FIG. 8 is a cross-sectional view taken along the line 8—8 of FIG. 7.

FIGS. 7, 8 and 9 show an alternate embodiment of the invention. In this arrangement a wrench of a style currently marketed is illustrated. The wrench includes a handle 12 having a ratcheting mechanism 12 at each end. Each ratcheting mechanism includes a toothed gear 50 which is rotatably supported between the handle upper plate 14 and lower plate 16. Each of the toothed gears 50 includes a hexagonal opening 52 therein, the openings being of different size so that the wrench may be used on two different size nuts or bolts. Levers 50, 54 control the engagement of the handle 10 with the ratcheting mechanism; that is, the direction in which torque is applied to the ratcheting mechanism by movement of the handle.

The endless chain 32 is looped around the opposed toothed gears 50 so that each of these gears rotate when the other rotates. Spacer 38 is configured so that the endless chain 32 is retained within the confines of the top and bottom handle plates 14 and 16 adjacent each end of the handle but is exposed on both sides of the handle near the middle. To retain the endless chain 32 within the confines of the top and bottom plates 14 and 16 adjacent the ends, opposed pins 56 are employed. In the arrangement of FIG. 7, the endless hain 32 is exposed to the engagement by the thumb and fingers of the users on both sides of the middle portion of the wrench handle so that manual thumb and finger pressure may be utilized to apply rotational torque to the ratcheting mechanisms at both ends.

In order to increase frictional engagement of the thumb and fingers with the endless chain 32, outward extending projections 58 may be integrally formed with the chain, the projections being positioned between adjacent openings.

The principle of the operation of the wrench of FIG. 7 and that of FIGS. 1 and 2 is the same, and these different embodiments illustrate the fact that the invention may be employed with any number of wrench designs.

While the invention has been described in a certain degree of particularity, it is manifest that many changes may be made in the details of construction and in the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

I claim:

1. An improved ratcheting wrench comprising:

an elongated handle adaptable to be engaged by the hand of the user by which torque may be applied to a member to be rotated, the handle having a top, bottom, opposed sides, and opposed ends;

a ratchet member rotatably supported at one end of said handle having means to engage a member to be rotated, the rotational axis of the ratchet member being perpendicular said handle top and bottom, the ratchet member being rotatably locked to said handle when said handle is rotated relative to the ratchet member axis in one direction and free to rotate about said member in unlocked relationship when the handle is rotated in the opposite direction;

an endless belt carried by said handle and engaged by and rotated with said ratchet member, said belt being in a plane parallel said handle top and bottom; and means in areas on opposite of said handle sides intermediate the handle ends, whereby the belt is exposed exteriorly of the handle on both sides and may be engaged by the thumb on one side and fingers on the other side by the user to enable the user to apply rotational torque to said ratchet member by manual contact with said belt and by moving his thumb in one direction and his fingers in the opposite direction.

2. An improved ratcheting wrench according to claim 1 including:

A rotatable sheave member received by said handle at a point displaced away from said ratchet member and rotatable about an axis parallel the axis of said ratchet member, the sheave member receiving said endless belt thereabouts.

3. An improved ratcheting wrench according to claim 2 wherein said sheave member includes a knob portion affixed thereto extending above said wrench handle top side and wherein the sheave rotatably engages said belt, whereby said knob may be rotated to rotate said belt and thereby said ratchet member, said belt being exposed by said handle configuration for engagement by the thumb or fingers of the user between said sheave and said ratchet member.

4. An improved ratcheting wrench according to claim 1 including a rotatable bearing member received in said handle about an axis parallel said ratchet member axis and in said area of said handle configured to expose said belt, the bearing means engaging the inward side of said belt whereby thumb or finger pressure may be applied against said belt at said bearing member.

5. An improved wrench according to claim 1 including a second ratchet member of a different size than said first rachet member rotatably supported at the end of said handle opposite said first ratchet member, said belt received and rotatably engaged by both said first and second ratchet members.

6. An improved wrench according to claim 1 wherein said handle comprises:

a top plate providing said handle top side;

a bottom plate providing said handle bottom side;

a spacer member between said top and bottom plates, said top and bottom plates having aligned openings therein rotatably receiving said ratchet member, said belt being of a width less than the thickness of said spacer member, said belt being carried between said top and bottom plates and exteriorly of said spacer member, said plates and said spacer members being configured to expose said belt in at least one area for engagement by the thumb or fingers of the user.

* * * * *